United States Patent [19]

Lohr

[11] Patent Number: 4,470,712

[45] Date of Patent: Sep. 11, 1984

[54] HAND HELD PRINTER AND PRINTING GUIDE

[76] Inventor: Raymond J. Lohr, 5043 Sterrettania Rd., Erie, Pa. 16506

[21] Appl. No.: 430,814

[22] Filed: Sep. 30, 1982

[51] Int. Cl.[3] ..... B41J 1/32

[52] U.S. Cl. ..... 400/165.3; 400/139; 101/103

[58] Field of Search ..... 400/139, 165.3, 165.2, 400/165.1; 101/103, 109, 327, 368

[56] References Cited

U.S. PATENT DOCUMENTS

| | | | |
|---|---|---|---|
| 299,785 | 6/1884 | Herrington et al. | 400/165.2 |
| 345,697 | 7/1886 | Ingersoll et al. | 400/165.2 |
| 441,068 | 11/1890 | Hurlbut | 400/165.2 |
| 516,973 | 3/1894 | Hess | 400/165.2 |
| 566,525 | 8/1896 | Mitts | 101/103 |
| 781,124 | 1/1905 | Bradley | 400/165.3 |
| 1,450,627 | 4/1923 | Darnley | 400/165.1 X |
| 1,571,656 | 2/1926 | Wetherill | 400/165.3 |

*Primary Examiner*—Clifford D. Crowder

*Attorney, Agent, or Firm*—Wayne L. Lovercheck; Charles L. Lovercheck; Dale R. Lovercheck

[57] ABSTRACT

Disclosed herein is A printing toy in combination with a printing guide. The printer comprises a disk like print dial with rubber indicia projecting therefrom along the outer periphery, a cover, an ink roller, and a foot guard extending from the bottom of the cover to shield the indicia adjacent the one being printed so that only one indicia is printed at a time. The indicia can be of letters or cartoons. The printing guide is used to guide the printer in order to print letters in a straight row to form a word.

12 Claims, 11 Drawing Figures

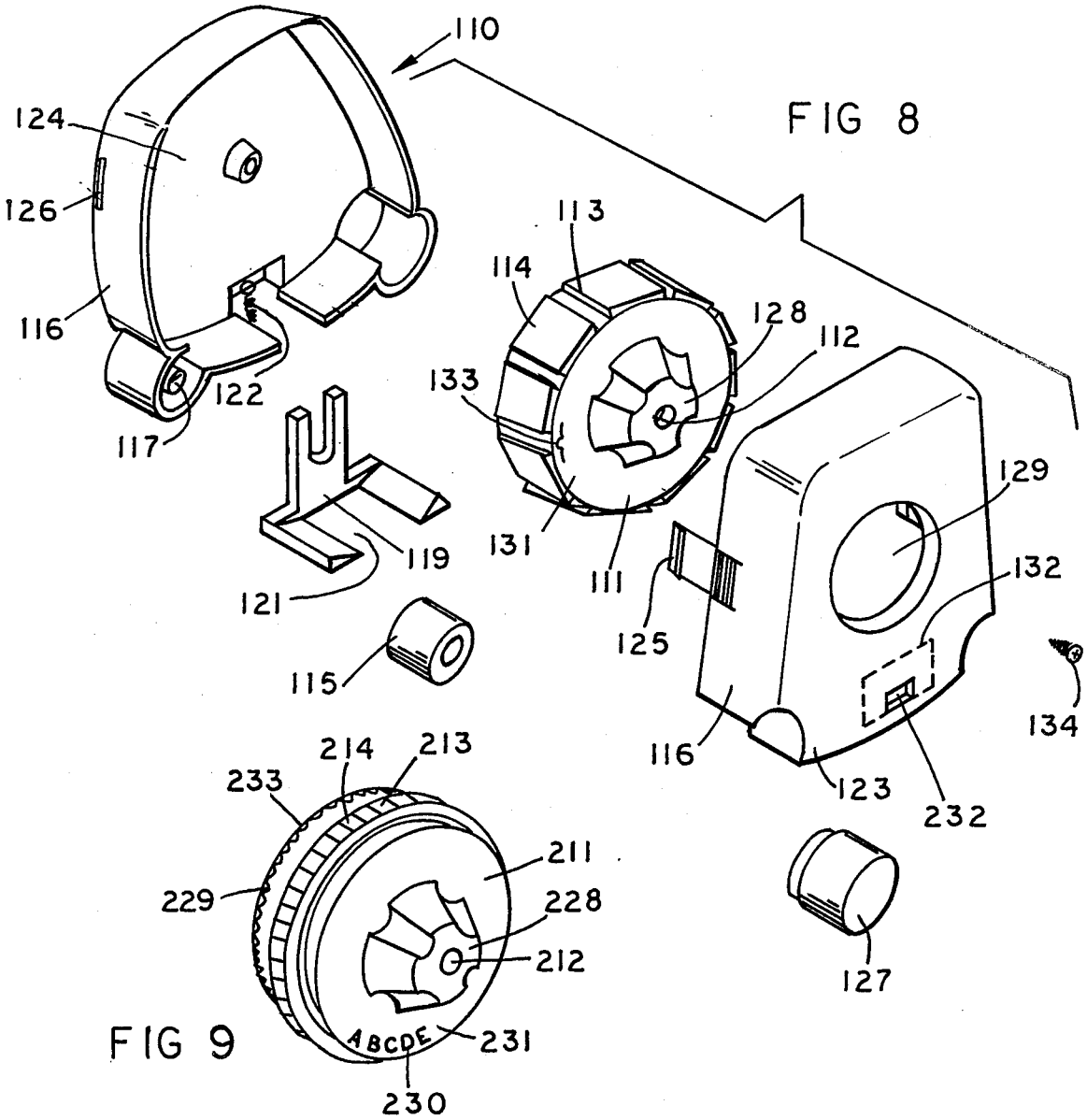
FIG 8
FIG 9
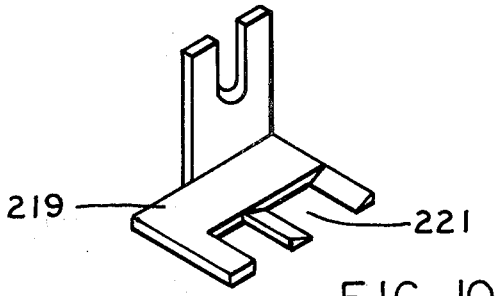
FIG 10

HAND HELD PRINTER AND PRINTING GUIDE

BACKGROUND OF THE INVENTION

The present invention relates to the field of printing devices and more particularly to the field of hand held printing devices having means to print one of several alternative characters at a time. Hand held stamps are well known in the art which provide for the imprinting of a fixed message or one of a few fixed messages. Applicant is not aware of any prior teaching which would provide an operator with a simple mechanism for printing original text as provided by the use of applicant's invention.

SUMMARY OF THE INVENTION

The present invention provides a hand held printing toy which is composed of a printing wheel having spaced characters suitable for imprinting about its circumference and adjusting apparatus to move the desired character into position for imprinting and a biased foot or shield which will permit printing only of the intended image. The adjusting apparatus may be a knob attached through the case to the printing wheel, or it may be a tape fixed to the printing wheel. In each case external provision is made to indicate to an operator what letter or symbol is aligned on the printing wheel to be printed. A foot is provided with an opening to permit the symbol to be printed access to the surface to be printed. The foot covers the adjacent indicia or symbols so that only one is printed at a time. The foot is biased away from the printing wheel so that when the operator pushes down the print wheel will be moved adjacent the foot. The indicia adjacent the opening will be flattened and the indicia aligned with the opening will extend through the opening and be printed.

The even spacing of characters printed is made possible through means of a printing guide which holds the paper in a fixed position and provides evenly spaced notches which engage a projection on the printer and establish the position for each successive character.

It is the object of the invention to provide an improved printing toy.

Another object of the invention is to provide a printing toy that can print letters of the alphabet in a straight row.

Another object of the invention is to provide a printing toy that is easy to produce, inexpensive to manufacture, and simple to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor detail of construction without departing from the spirit or sacrificing any of the advantages of the invention.

GENERAL DESCRIPTION OF THE DRAWINGS

FIG. 8 is an exploded view of second embodiment of the invention.

FIG. 9 is an alternate print wheel for the second embodiment of the invention.

FIG. 10 is an alternate foot guard for the second embodiment of the invention.

DETAILED DESCRIPTION OF THE DRAWINGS

Figure 1:
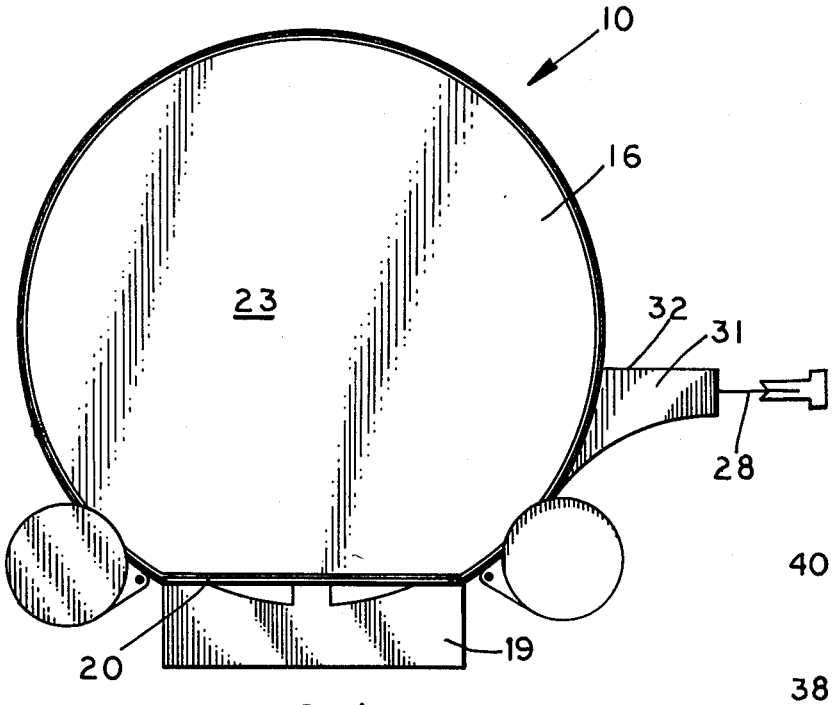
FIG. 1 is a front view of the first embodiment of the printer.
Figure 2:
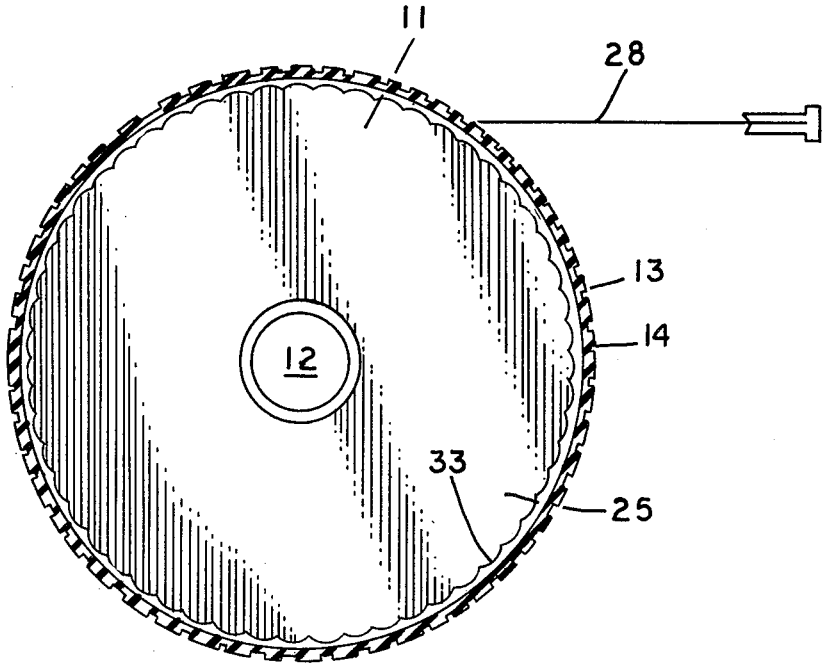
FIG. 2 is a back view of the print dial for the first embodiment of the printer.
Figure 3:
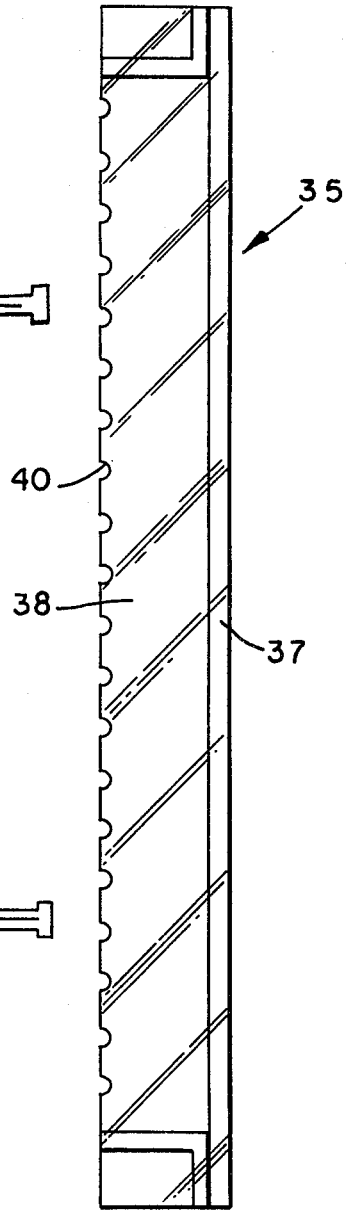
FIG. 3 is a side view of the printing guide.
Figure 4:
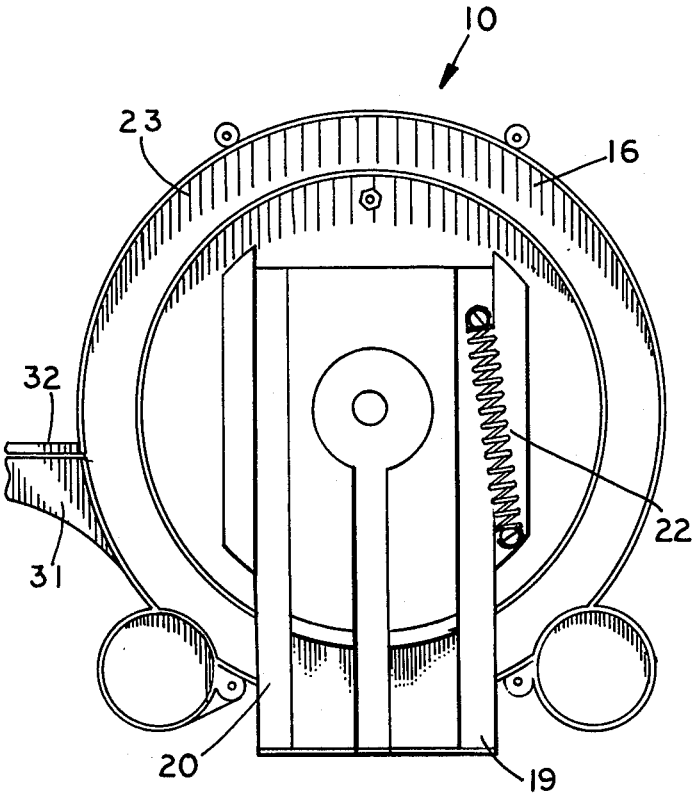
FIG. 4 is an inside view of the front cover of the first embodiment of the printer.
Figure 6:
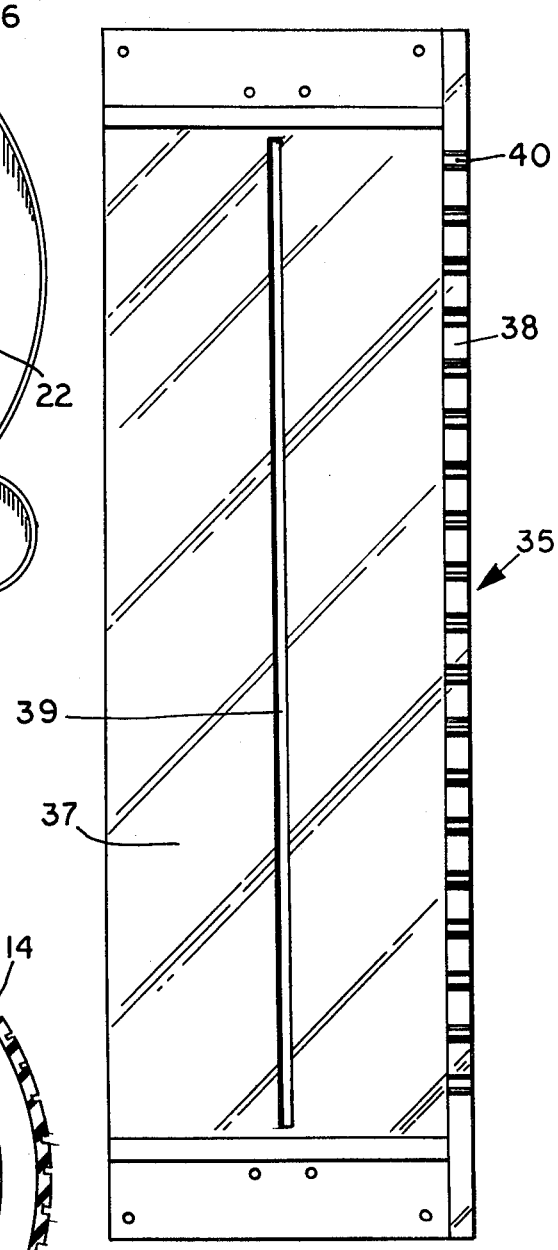
FIG. 6 is a top view of the printing guide.
Figure 5:
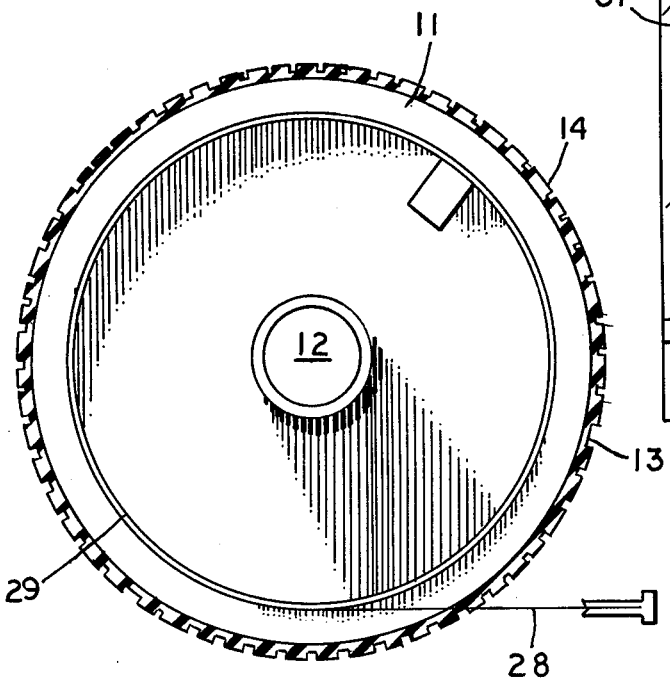
FIG. 5 is front view of the print dial for the first embodiment of the printer.
Figure 7:
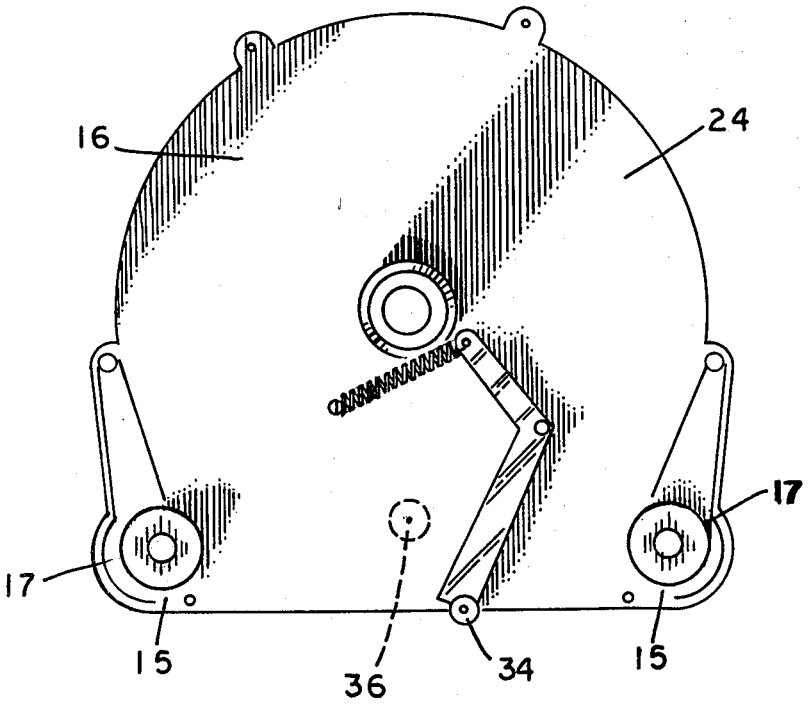
FIG. 7 is an inside view of the back cover of the first embodiment of the printer.
Figure 11:
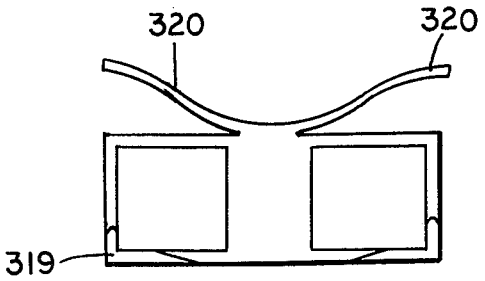
FIG. 11 is an alternate foot guard for the second embodiment of the invention.

Now, with more particular reference to the drawings, a printing toy is disclosed generally referred to as 10. The printer 10 has a print dial 11 which has a disk like shape and rotates about an axle 12. A rubber stamp strip 13 is disposed on the outer periphery of the print dial. The stamp strip is formed of resilient rubber spaced sides 14; each spaced side 14 having a raised symbol or indicia such as a letter of the alphabet on its surface. When the player pushes the symbol or indicia against a sheet of paper on a flat surface, the resilient side 14 flattens against the flat surface printing the symbol in the manner of a flat stamper rather than a stamper with a curved surface.

An ink roller 15 may be positioned adjacent the print dial 11 so that ink on the roller will rub on the spaced sides 14 of the print dial when the print dial 11 is rotated about its axle 12. The provision of two ink rollers 15, one to either side of the foot guard 19, insure that the indicia is inked no matter which direction the print dial is rotated. The pins 17 supporting the ink rollers may be of a molded type or a spring supported type.

The printer 10 has a frame 16 which includes a front cover 23 and a back cover 24 connected together. The axle 12 of the print dial 11 is connected to the frame 16. A foot guard 19 extends through an opening 20 in the frame 16. The foot guard 19 is slidably attached to the axle of the print dial. The foot guard 19 acts as a mask for the symbols adjacent the one to be printed so that only one symbol is printed at a time. There is an opening in the foot guard 19 through which the symbol to be printed can extend. The foot guard 19 moves toward and away from the print dial 11. A coil spring 22 urges the foot guard away from the print dial.

To print the symbol such as a letter of the alphabet, the player rotates the symbol on the print dial 11 into alignment with the opening in the foot guard 19. Then he pushes the foot guard 19 against a sheet of paper on a flat surface with a downward movement of the hand, forcing the print dial 11 and foot guard 19 into contact so that the raised letter extends through the opening in the foot guard and prints the letter.

A pull tape 28 is wrapped around a circular extension that is concentric with and a part of the print dial 11. When the pull tape 28 is pulled it rotates the print dial 11 until a particular letter is in alignment with the opening in the foot guard 19. The player can determine which letter of the alphabet is in alignment with the opening by looking at the symbol printed on the pull tape 28 and displayed in an opening 32 in an extension 31 of the frame. The letter displayed in the opening 32 in the extension 31 corresponds to the letter in alignment with the opening in the foot guard 19.

A scalloped edge 33 is near the outer periphery of the print dial but is located on the flat side 25 of the print dial. There is one scallop in the scalloped edge for each resilient spaced side with a raised symbol. A spring loaded pin 34 catches in the scallops to prevent the print dial 11 from rotating further once a particular letter has been aligned with the opening in the foot guard 19.

The printer 10 has forty-four spaced sides with symbols in them such as the letters of the alphabet, numericals, basic punctuation marks, and symbols signifying mathematical operations.

The printer 10 is in combination with a printing guide 35 which has a bottom member 37 and a side member 38. The bottom member has a slot 39 which holds down a sheet of paper extended through the slot 39 when the printing guide 35 is placed on a flat surface. There are notches 40 formed in the side member 38 to receive a locating pin 36 on the back cover 24 of the printer 10. By positioning the printer adjacent the printing guide 35 with the locating pin 36 in one of the notches, the symbols can be printed across the paper in a straight row.

The second embodiment of the invention shown in FIG. 8 shows the printer generally referred to at 110 with a print dial 111 which has a disk like shape and rotates about an axle 112. The stamp strip 113 is made of several resilient spaced sides 114 disposed on the outer periphery of the print dial 111. Each spaced side has a raised symbol such as a picture or cartoon on its surface. When the player pushes the symbol against a sheet of paper on a flat surface the resilient side 114 flattens against the flat surface printing the symbol.

An ink roller 115 with ink is positioned on each side of the print dial 111 so that ink rubs on the spaced side 114 of the print dial when the print dial 111 is rotated about its axle 112. The two ink rollers insure that the cartoon is inked no matter which direction the print dial is rotated. Pin 117 supporting the ink roller may be of a molded type or a spring supported type.

The printer 110 has a frame 116 which includes a front cover 123 and a back cover 124 connected together by spring lug 125 and slot 126. The front cover is released from the back cover when the spring lug 125 is pressed. Cover 27 can be removed to replace the ink roller 115. The axle 112 is connected to the frame 116.

A foot guard 119 extends through an opening in the frame 116. The foot guard 119 is slidably attached to the axle of the print dial. The foot guard 119 acts as a mark for the symbols adjacent the one to be printed so that only one symbol is printed at a time. There is a large opening 121 in the foot guard 119 through which the symbol to be printed can extend. The foot guard moves toward and away from the print dial 111. A coil spring 122 urges the foot guard away from the print dial.

To print the symbol such as a cartoon figure, the player rotates the symbol on the print dial into alignment with the opening 121 in the foot guard 119. Then he pushes the foot guard 119 against a sheet of paper on a flat surface with a downward movement of the hand, forcing the print dail 111 and foot guard 119 into contact so that the raised cartoon extends through the opening 121 in the foot guard and prints the letter.

The print dial is rotated in either direction with the knob 128 attached to the axle of the print dial and extended through the hole 129 in the print cover. The player can determine which cartoon is in alignment with the opening 121 by looking at the symbol printed on the flat side 131 of the print dial and displayed through the large window opening 132 shown in phantom in the front cover 123. The cartoon displayed in the window 132 corresponds to the cartoon in alignment with the opening 121.

A notch 133 is positioned in the flat side 131 of the print dial next to each resilient spaced side 114. A spring detent (not shown) similar to pin 34 of the first embodiment catches in the notches and prevents the print dial from rotating once a particular symbol has been aligned with the opening 121 in the foot guard.

The second embodiment of the printer has twelve resilient spaced sides and therefore can print twelve cartoons. By releasing the front cover 123 from the back cover 124 and removing screw 134 the print dial 111 and the foot guard 119 may be removed. Print dial 211 shown in FIG. 9 and foot guard 219 shown in FIG. 10 can replace the print dial and foot guard of the second embodiment.

Print dial 211 has an axle 212 and a stamp strip 213 made of forty-four resilient spaced sides 214 and disposed on the outer periphery of the print dial. The spaced sides 214 have raised symbols such as letters, numerical, punctuation or mathematical operations. Knob 228 extends through the front cover and is used to rotate the print dial to position a particular symbol in alignment with the opening 221 in the foot guard 219. The foot guard 219 is very similar to the foot guard in the first embodiment and varies from the foot guard in the second embodiment in that foot guard 219 has a smaller opening 221 than foot guard 119.

Symbols 230 identical to the raised symbols on the resilient spaced sides 214 are printed on the flat side 231 of the print dial 211 so that the symbol 230 displayed in the small window opening 232 shown in FIG. 8 exactly corresponds to the symbol in alignment with the opening 221 in the foot guard.

A scalloped edge 233 on a circular curved surface 229 is concentric to the disk like shape of the print dial. A spring detent similar to pin 34 of the first embodiment catches in the scalloped edge to prevent the print dial from slipping once a particular letter is aligned with the opening 221 in the foot guard.

In a preferred embodiment, a foot guard 319 of a resilient material such as plastic can be used instead of the previously discussed foot guard. The foot guard 319 may have a large opening as in foot guard 119 or a small opening as in foot guard 219. A coil spring such as spring 122 is not needed in combination with foot guard 319. Instead foot guard 319 has two resilient curved flanges 320 which urge the foot guard away from the print dial but which deflect under pressure. Thus when an operator pushes downwardly the indicia will project through the opening in the foot.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A hand held printer comprising, a frame, a print dial having a generally disk like shape supported in the frame, said print dial being adapted to rotate about an axis through the center of said print dial, means attaching said axis of said print dial to said frame, a stamp strip, means attaching said stamp strip to said print dial, an ink roller rotatably affixed to said frame adjacent said print dial and rotatably engaging said spaced sides of said stamp strip when said print dial is rotated about its said axis, indicia integrally attached to and extending outwardly from each of said spaced sides of said stamp strip, a foot guard slidably extending through an opening in said frame and positioned adjacent said print dial, said foot guard having an opening therein exposing one said indicia to be printed, said foot guard moves toward and away from said print dial, there being a means urging said foot guard away from said indicia to be printed whereby said printer will print said indicia when a player pushes the said foot guard against a sheet of printed material to be printed on, thereby forcing said foot guard into contact with said print dial and causing said indicia to extend through said opening in said foot guard and to contact said sheet of material to print said indicia, said frame comprises a front cover and a back cover, and a means connecting said front cover and said back cover, means to rotate said print dial about said axis so that a particular spaced side with said indicia extending therefrom is displayed in said opening in said foot guard, a means to positively locate the indicia being displayed in said opening in said foot guard, and a means preventing said print dial from rotating further once said particular indicia is displayed in said opening in said foot guard, said means to rotate said print dial comprising a pull tape wrapped around a concentric extension of said print dial and extending therefrom, said pull tape rotates said print dial when said pull tape is pulled, said pull tape extending out of said front and back covers, and said means to positively locate said indicia being displayed in said foot guard comprises an identical indicia printed on said pull tape, whereby the indicia displayed in said opening in said foot guard and in position to be printed corresponds to said identical indicia on said pull tape which is displayed in an opening in an extension from said frame.

2. The printer recited in claim 1 wherein there are two said ink rollers with ink so that the indicia to be printed will be inked as it approaches the opening in the foot guard from either direction.

3. The printer recited in claim 1 wherein said means attaching said ink roller to said frame is spring loaded.

4. The printer recited in claim 1 wherein each said indicia on each said spaced side is a letter, number or punctuation sign.

5. The printer recited in claim 1 wherein each said indicia is a picture.

6. The printer recited in claim 1 wherein said means urging said foot guard away from said indicia to be printed comprises a spring coil.

7. The printer recited in claim 1 wherein said means urging said foot guard away from said indicia to be printed comprises, a spring integrally attached to said foot guard and fitted into a cavity in the back of said frame, said spring being made of an elastic material and having two flanges adapted to detect when pressure is exerted on said foot guard.

8. The printer recited in claim 1 wherein said means connecting said front cover to said back cover is a spring lug and a slot, whereby the front cover is released from said back cover when said spring lug is pressed, and there is a second front cover for said ink roller adapted to be removed for the replacement of said ink roller.

9. The printer recited in claim 1 wherein said means connecting said front cover to said back cover is cement.

10. The printer recited in claim 1 wherein said means preventing said print dial from rotating further once said particular indicia is positioned adjacent said opening in said foot guard comprises a scalloped edge, said scalloped edge having a scallop corresponding to each said spaced side with said indicia, said scalloped edge disposed on a flat end of said disk like shape substantially in a circle, and a pin adapted to catch in the scallops of said scalloped edge.

11. The printer recited in claim 1 wherein said means preventing said print dial from rotating further once said particular indicia is positioned adjacent said opening in said foot guard comprises, a plurality of notches, each said notch being disposed on a flat end of said disk like shape adjacent and corresponding to a spaced side of said print dial, and a pin adapted to catch in said notches.

12. In combination, a printer and a printing guide, said printer comprising a frame and a print dial supported thereon, the print dial having a generally disk like shape, and adapted to rotate about a fixed axis, a pull tape having an end attached to the print dial and adapted to be wrapped along its length around a concentric extension of said print dial, said tape being adapted to rotate said print dial when the tape is pulled or pushed by an operator, a free end of said tape extending through said frame where it may be grasped by an operator, said tape having indicia thereon, a stamp strip having indicia integrally disposed therein, said stamp strip being fixed to a curved surface of said disk like shape, an ink roller positioned adjacent said print dial, an opening in said frame with a foot guard slidably extending therefrom, said foot guard having an opening through which said indicia extends when said foot guard is pressed against a sheet of material thereby printing said indicia, said frame having a locating pin extending outwardly therefrom, said printing guide comprising a bottom member, a side member, and means to connect said bottom member to said side member, said bottom member having means for holding adapted to receive and hold in position a sheet of material to be printed on, said bottom being adapted to be laid on a flat surface, said side having a plurality of notches formed therein and adapted to receive said locating pin on said printer, whereby said indicia may be printed in a straight row by positioning said printer adjacent said printing guide with said locating pin in one of the plurality of notches each time said indicia is printed.

* * * * *